US008899798B2

(12) United States Patent
Swanson

(10) Patent No.: US 8,899,798 B2
(45) Date of Patent: Dec. 2, 2014

(54) COLOR CUSTOMIZABLE TABLE LAMP AND METHOD OF MAKING THE SAME

(71) Applicant: Dennis K. Swanson, Woodland Hills, CA (US)

(72) Inventor: Dennis K. Swanson, Woodland Hills, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 125 days.

(21) Appl. No.: 13/690,048

(22) Filed: Nov. 30, 2012

(65) Prior Publication Data

US 2014/0153258 A1 Jun. 5, 2014

(51) Int. Cl.
*F21S 8/08* (2006.01)
*F21V 3/00* (2006.01)

(52) U.S. Cl.
CPC ..... *F21V 3/00* (2013.01)
USPC ..... 362/410; 362/412

(58) Field of Classification Search
USPC ..... 362/410, 412–417
See application file for complete search history.

(56) References Cited

U.S. PATENT DOCUMENTS

| | | | | |
|---|---|---|---|---|
| 225,701 | A * | 3/1880 | Haines | 362/415 |
| 6,916,108 | B2 | 7/2005 | Swanson | |
| 7,347,593 | B1 | 3/2008 | Swanson | |
| 2006/0002118 | A1 * | 1/2006 | Lin | 362/412 |
| 2012/0140494 | A1 * | 6/2012 | Gu et al. | 362/411 |

* cited by examiner

*Primary Examiner* — Julie Bannan
(74) *Attorney, Agent, or Firm* — Novak Druce Connolly Bove + Quigg LLP

(57) ABSTRACT

A lamp having a hollow clear body supported between a base and a cap, a hollow pipe carrying an electrical cord and a light socket dispensed internally of said hollow clear body between said base and said cap and removable through the open upper end of said body to allow the body to become free standing so that a color bearing material can be applied to the internal surface of the clear body.

3 Claims, 6 Drawing Sheets

COLOR CUSTOMIZABLE TABLE LAMP AND METHOD OF MAKING THE SAME

FIELD OF THE INVENTION

This invention relates generally to lamps and more particularly to a table lamp which includes a body which can be color coated to provide any color which a customer may desire.

BACKGROUND OF THE INVENTION

Floor lamps, desk lamps and table lamps are all very well known in the lighting industry. Such lamps and particularly lamps which are categorized as table lamps or desk lamps have a body in which the electrical wiring is normally situated and extends from the bottom of the body to the top into contact with a light socket which is utilized to contain the electrical lighting apparatus such as an incandescent or florescent bulb. The body of the lamp usually is decorated in some manner or has applied a particular color to it. It has now become very common for individuals to have such items as table or desk lamps customized for a particular purpose. As one example of such customization individuals will have particular subject matter of importance to them such as hand painted scenes, photographs, various decorated designs and the like applied to a lamp shade through the utilization of Giclee printed material which is secured to the lamp shade. Such a lamp shade and a method of making the same is disclosed in U.S. Pat. No. 7,347,593 the contents of which is incorporated herein by references. If an individual has a Giclee printed lamp shade which includes as part thereof a particular color, the individual may also desire the body of the lamp to be of that same color. Since there are an unlimited number of colors which can be desired by various customers it would become uneconomical to maintain an inventory of lamps having a body with this wide variation of colors. It would therefore be desirable that such a lamp could be independently customized to a color which a customer desires thereby enabling the supplier of the lamps to order a large number of generic lamps each of which could then be color customized as desired, however, in accordance with prior art structures if such is done it would generally require extensive dismantling of the lamp to gain access to the interior thereof to apply a color bearing material such as paint to the inside to provide the desired custom color.

Therefore, there is a need in the lighting industry for a lamp which has a body that can be color customized as desired at the request of a customer and at the same time will not require extensive dismantling or reassembly after such color customizing.

BRIEF SUMMARY OF THE INVENTION

A lamp which can be color customized and which includes a hollow clear body having a top and bottom, a hollow pipe carrying an electrical cord and a light socket supported within the body and removably attachable thereto by means which can removed to allow the hollow pipe carrying the electrical cord and socket to be removed intact from the body so that the body member may have a color bearing material applied internally thereof.

In addition, the invention also includes a method of making a color customizable lamp which includes providing a lamp having a hollow clear body disposed between a cap and a base, coating the inside of the hollow clear body with a color bearing material and reassembling the hollow body between the cap and the base.

DETAILED DESCRIPTION OF THE INVENTION

A lamp constructed in accordance with the principles of the present invention includes a body which is generic in that it is constructed of a clear material that is not colored. The lamp will also include internally thereof an assembly carrying the electrical cord and the socket which is adapted to receive the illuminating element of the lamp, this assembly is suspended between the top and the bottom of the body of the lamp with the bottom of the lamp resting upon a base. This assembly can be manufactured and shipped to the supplier in large numbers at a relatively low cost simply because each of the bodies are generic in that they have no color of any type. When the customer orders a lamp to have a particular color which may be selected from a large variety of colors, the internal assembly carrying the electrical cord and the socket may be removed from the lamp allowing the body of the lamp to become free standing. The supplier of the lamp may then provide a color carrying material such as paint to the interior surface of the body of the lamp to provide the color which the customer has indicated as being desired. Thus the lamp can be customized to any color desired by the customer with the ability to then reassemble the assembly carrying the cord and the socket to the lamp without having to rewire the lamp. It can thus be seen that a small amount of dismantling is required to provide the customized color lamp.

Figure 1:
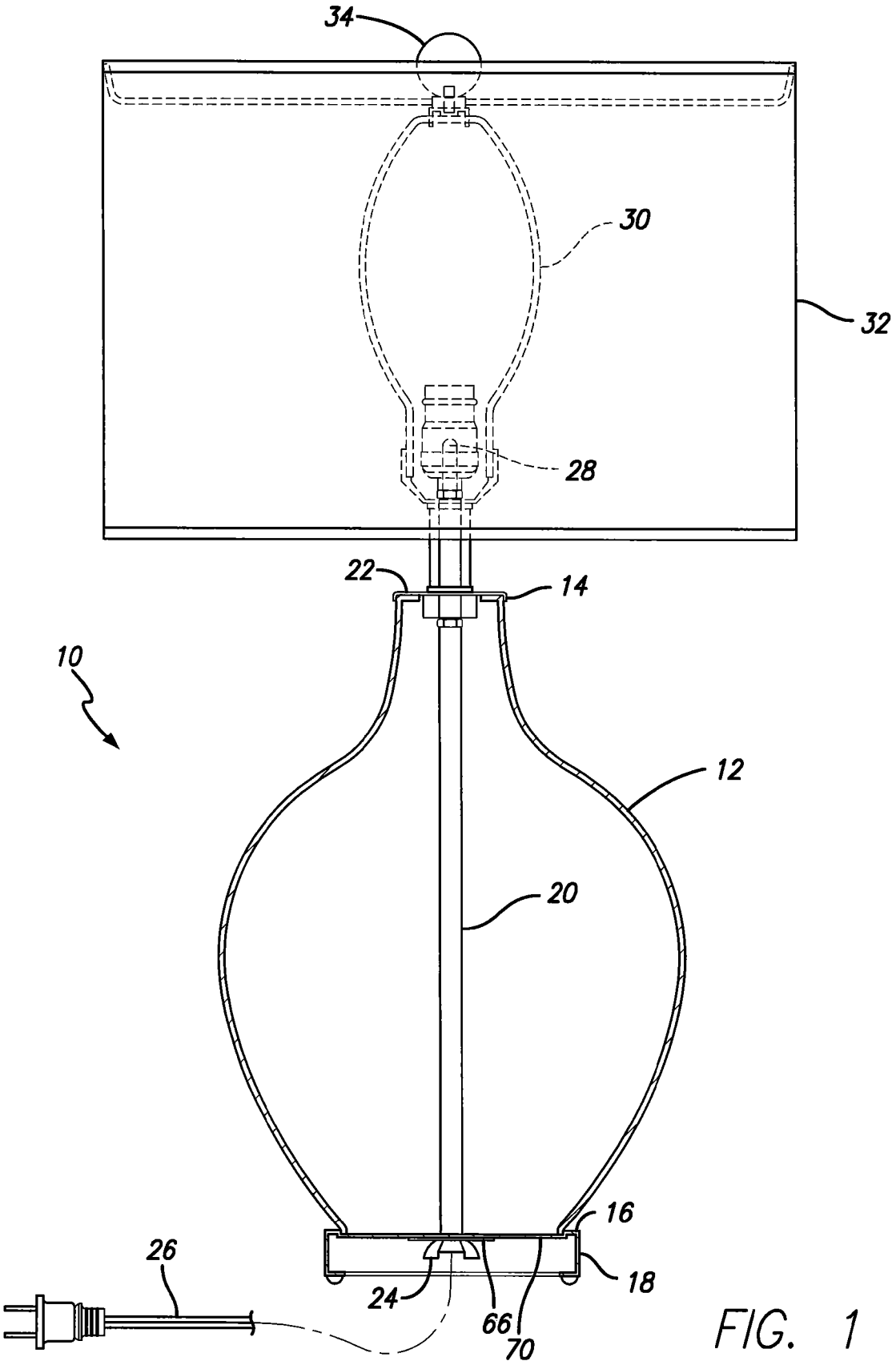
FIG. 1 is a fragmented cross sectional view of a lamp constructed in accordance with the principles of the present invention.

Referring now particularly to FIG. 1, there is illustrated at 10 a lamp constructed in accordance with the principals of the present invention. As is therein shown, there is provided a hollow body 12 having a top 14 and a bottom 16 which are open, the bottom 16 of the body 12 rests upon a base 18. An assembly 20 (to be described in more detail herein below) is disposed internally of the hollow body 12 between the base 18 and a cap 22 which rests upon the open upper end 14 of the body 12. A wing nut 24 is secured to the lower end of the assembly 20 and when tightened secures the assembly 20 internally of the hollow body 12 between the base 18 and the cap 22. The assembly 20 includes an electrical cord 26 which is disposed internally of the assembly 20 and is connected to a socket 28 which receives the illuminating elements such as an incandescent or florescent bulb. A harp 30 carries a shade 32 which is attachable to the harp as is well known by a filial 34. The shade 32 and the harp 30 would normally would not be included as part of the lamp when it is shipped from the factory to the supplier. As a result the customer may then select any shade desired for example utilizing the Giclee printed shade as described in U.S. Pat. No. 7,347,593 as above referred to.

Figure 2:
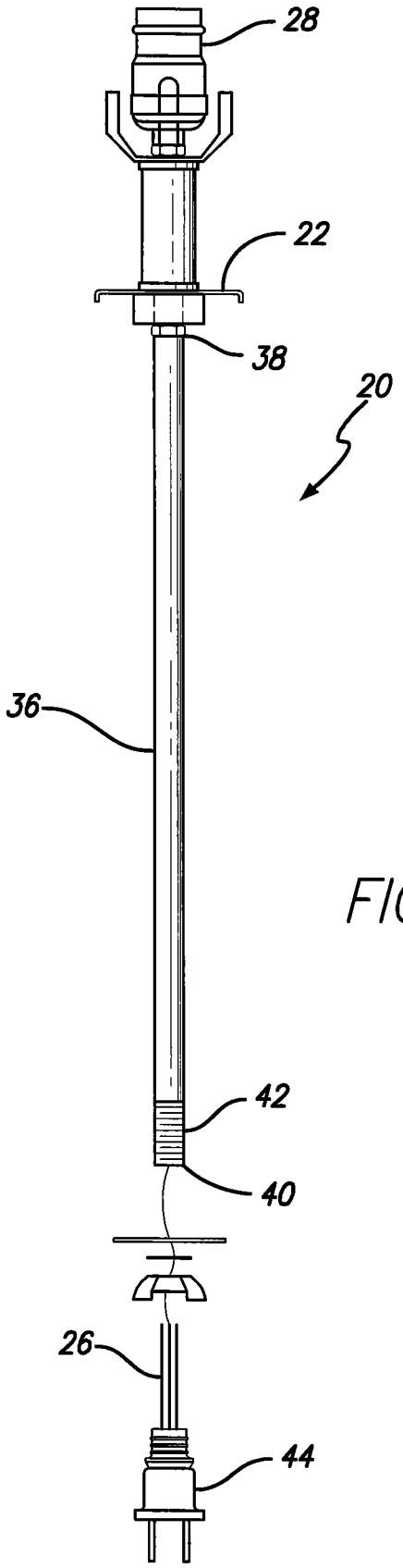
FIG. 2 is schematic representation of an assembly including the electrical connections which are disposed internally of the lamp of FIG. 1.

The assembly 20 is illustrated further in FIG. 2 and as is therein shown includes a hollow pipe 36 having a first end 38 and a second end 40. The second end 40 is threaded as shown at 42. Disposed internally of the hollow pipe 36 is the electrical cord 26 which has an electrical plug 44 secured to the end thereof. The opposite end of the electrical cord 26 is wired to the socket 28 to provide electrical energy to the incandescent or florescent bulb which will be secured thereto. The cap 22 is secured by an appropriate fastening apparatus as will be described more fully herein after. It will recognized by those skilled in the art particularly with reference to FIGS. 1 and 2 that the assembly 20 is secured together as one unit and when the wing nut is removed from the threads 42 at the second end 40 of the pipe 36 the assembly as shown in FIG. 2 can be removed from the top open end 14 of the body 12.

Figure 3:
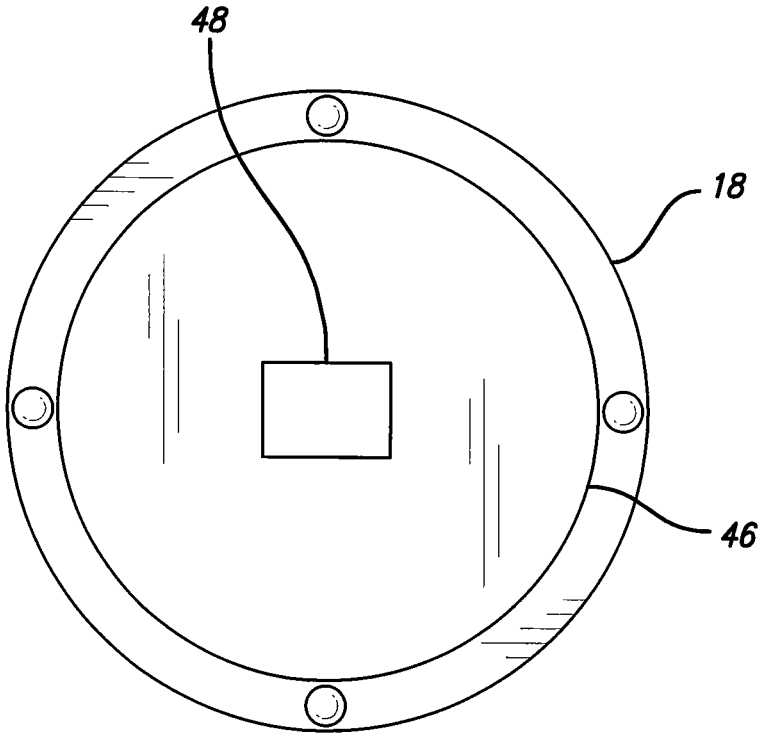
FIG. 3 is a plan view of a base for the lamp as shown in FIG. 1.

By reference now more particularly to FIG. 3, the base 18 is shown in top plan view and as therein shown is circular and contains a ridge 46 within which the bottom 16 of the hollow body 12 rests to keep the body from moving laterally on the base 18. The base 18 defines an orifice 48 at the center thereof. The orifice 48 is of sufficient size so that the electrical plug 44 may pass there through thus enabling the entire assembly 20 as shown in FIG. 2 to be removed from the hollow body 12.

Figure 4A:
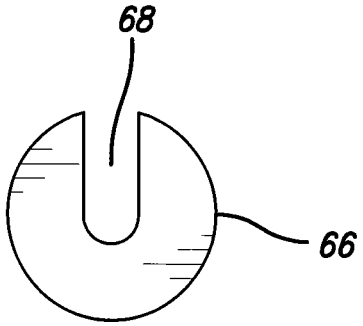
FIG. 4A is a plan view of a slotted washer shown in FIG. 4.
Figure 4:
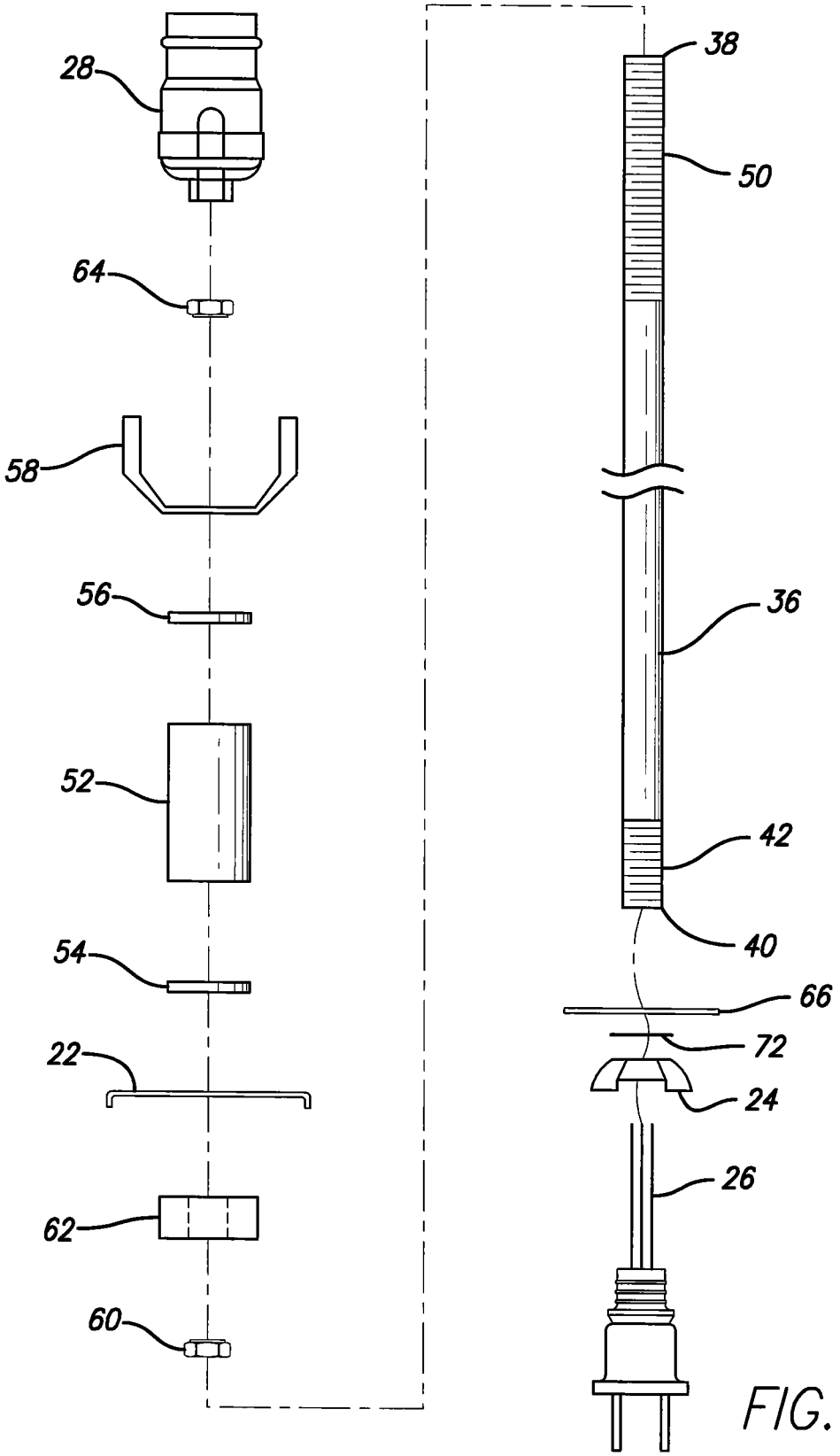
FIG. 4 is an exploded view of the assembly as shown in FIG. 2.

By referring now to FIG. 4, the assembly 20 is shown in an exploded view. As is illustrated the hollow pipe 36 includes threads 50 at the first end 38 thereof as well as the threads 42 at the second end 40 thereof. The threaded portion 50 extends upwardly through a metal neck 52, seating rings 54 and 56 and through a saddle 58 so that the socket 28 may be threadably secured thereto. A nut 60 is threaded downwardly over the upper end 38 of the pipe 36 and a spacer 62 is seated thereon. The cap 22 is then seated at the appropriate position on top of the spacer 62 with the metal neck 52 along with the seating rings 54 and 56 positioned over the threaded end 50 of the pipe 36. An appropriate lock washer and hex nut 64 are secured to the upper end of the threads 50 to hold the saddle, neck, seating rings and cap in place at the top end 38 of the hollow pipe 36. As indicated above, the electrical cord 26 is disposed internally of the hollow pipe 36 and extends upwardly there through and is wired to the socket 28. For purposes of clarity of the illustration the cord is only shown at the lower end of the pipe 36 but those skilled in the art will recognize that it extends through the pipe and into engagement by electrical connection to the socket 28.

To hold the assembly as illustrated in FIG. 2 in position in the lamp the wing nut 24 is secured to the threads 42 at the end 40 of the hollow pipe. A washer 66 which is slotted as shown at 68 in FIG. 4A is positioned so that the end 40 of the pipe 36 is positioned within the slot 68 and is seated on the bottom 70 of the base 18. The diameter of the washer 66 is such that it is larger than the orifice 48 in the base 18, thus the base 18 is retained in position on the bottom of the hollow body 12 by the wing nut and an appropriate lock washer 72 with the wing nut 24 being secured on the threads 42 at the second end 40 of the hollow pipe 36.

Figure 5:
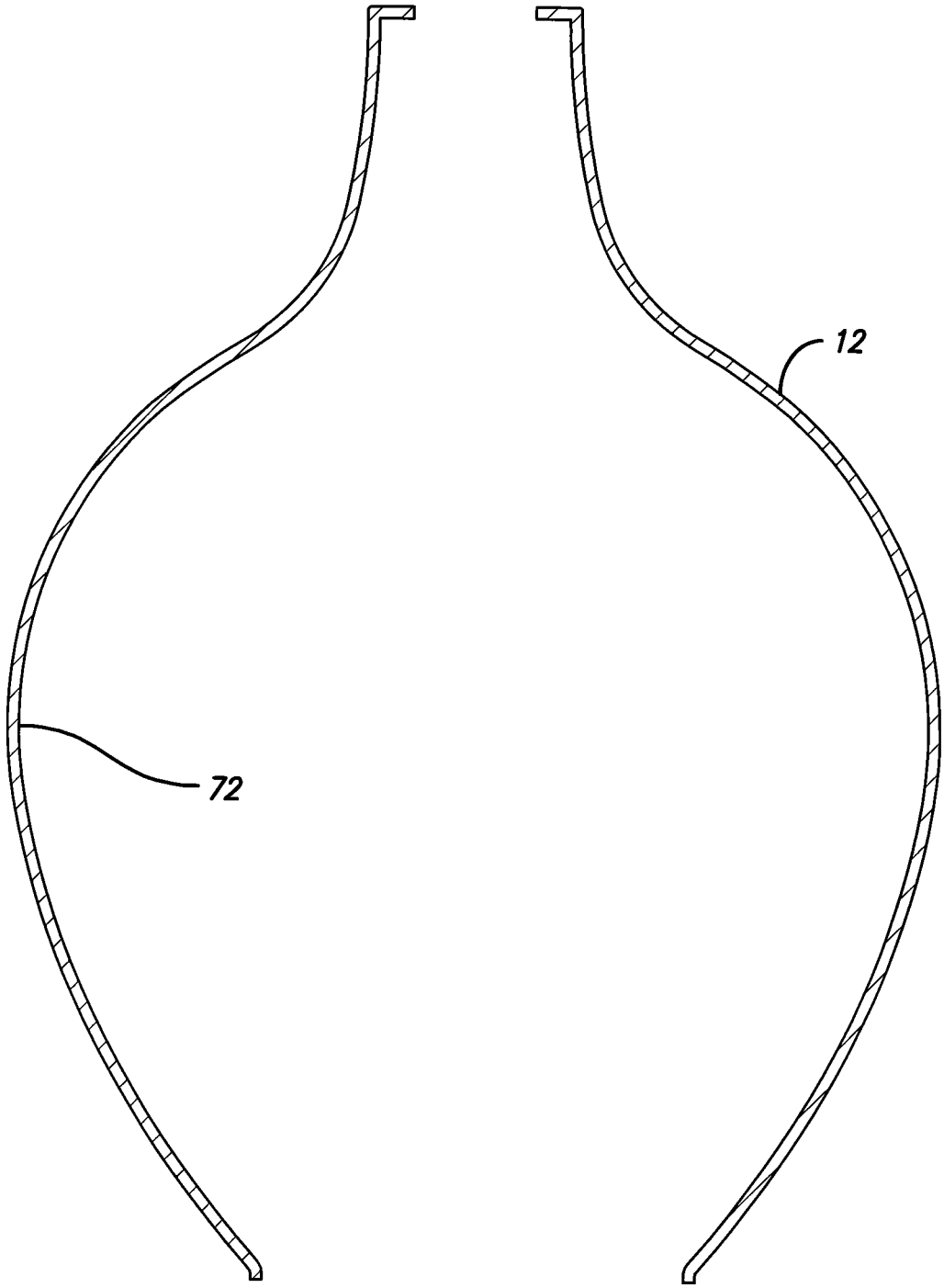
FIG. 5 is a cross-sectional view of the body of the lamp of FIG. 1 removed therefrom.
Figure 6:
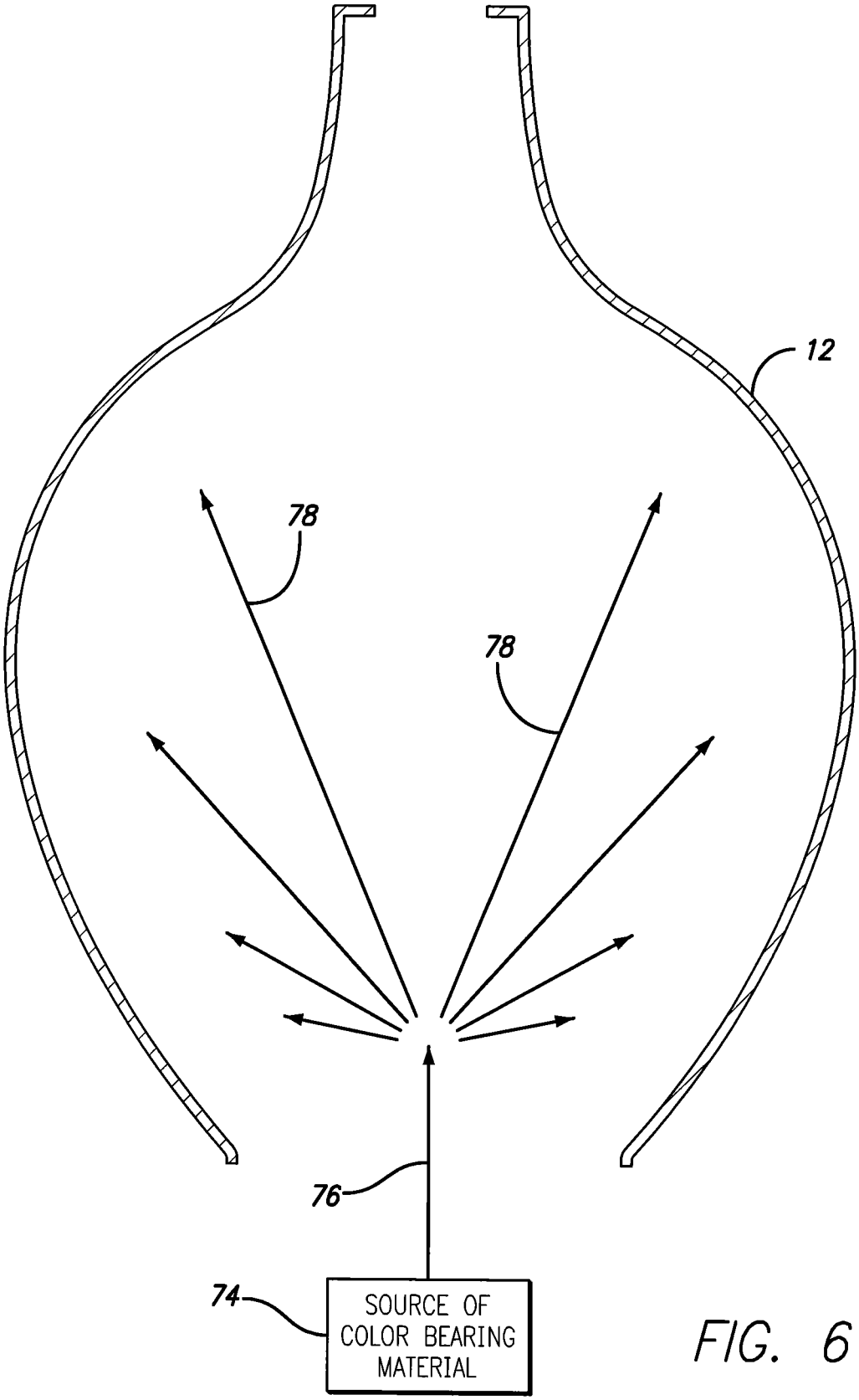
FIG. 6 illustrates the body as shown in FIG. 5 having a color bearing material disposed on the internal surface thereof.

From the foregoing description those skilled in the art will recognize that when the wing nut 24 is threadeably removed from the second 40 of the pipe 26 so that the base is then displaced from the bottom 14 of the hollow body 12, the entire assembly 20 as a unit can be removed from the open upper end 14 of the body 12 with the electrical plug 44 passing through the orifice 48 of the base 18. When such occurs the hollow body 12 then becomes a free standing unit as shown in FIG. 5 with the assembly 20 as shown in FIG. 2 removed completely therefrom. When the hollow body 12 has thus been separated as above described the color can be applied to the interior surface 72 of the hollow body 12 to provide the customized color which has been selected by the customer. By reference now to FIG. 6 it can be seen that the internal surface 72 is coated with a color bearing material which is provided from a source 74 thereof and is propelled through a conduit or the like 76 through the operation of a pump or air pressure or the like and is then dispensed as is illustrated by the arrows 78 so that it completely coats the interior surface 72 of the body 12. Alternatively a color bearing material such as paint may be applied internally and the body 12 then rotated in order to evenly distribute the color bearing material along the inner surface 72 of the hollow body 12 after which the paint or other color bearing material is allowed to set or dry. After such is done the hollow body 12 is then replaced on the base 18 and the assembly 20 as shown in FIG. 2 is inserted through the open top 14 of the body 12 so that the second end 40 of the hollow pipe 36 extends through the orifice 48 in the base 18. Thereafter the washer 66 is secured in place and the wing nut 24 is secured on the threads 42 at the second end 40 of the pipe 36 and is then snuggly secured in place to secure the assembly 20 into position internally of the body 12 between the cap 22 and the base 18. It will thus be seen by those skilled in the art that a customized color has been applied to the lamp with a relatively minor disassembly and reassembly. It will also be recognized that the supplier of the lamp to the customer in its customized fashion can accomplish this to provide any desired color which the customer may wish by maintaining a large supply of generic clear body lamps which can be easily disassembled, colored, and easily reassembled as above described.

There as thus been described color customizable lamp and the method of making the same which allows the supplier of the lamps to maintain a large inventory of generic lamps each of which may then be color customized relatively simply and without extensive dismantling of the lamp or the electrical circuit contained internally thereof in order to accomplish the same.

What is claimed as new and desired to be protected by Letters Patent of the United States is:

1. A color customizable lamp the color being customized according to the request of a customer, said lamp comprising:

a hollow clear body member having an open top and bottom;

a base, said bottom of said body member resting on said base;

a hollow pipe supported within said body, said second end of said pipe extending through said base member;

a light socket connected to said first end of said pipe;

an electrical cord disposed within said hollow pipe and connected to said light socket and extending from said second end of said pipe and terminating in an electrical plug;

a cap member secured to said first end of said pipe and resting on said top of said body member; and a split washer and a nut removably attachable to said second end of said pipe to secure said hollow pipe between said base and said cap and within said body member and wherein removing said cap allows said hollow pipe, said cord, and said plug to be completely removed through the top of said body member so that said body member is free standing and can have a color bearing material applied internally thereof.

2. A lamp as defined in claim 1, wherein said base defines an orifice therein, said second end of said pipe extending through said orifice, said orifice being of sufficient size for said electrical plug to pass through it when said pipe carrying said cord and said socket is removed through the top of said body.

3. A lamp as defined in claim 2, wherein said split washer has a diameter greater than the size of said orifice.

* * * * *